United States Patent [19]

O'Neill, Jr.

[11] 4,055,868

[45] Nov. 1, 1977

[54] DYEING METHOD

[75] Inventor: John H. O'Neill, Jr., Spartanburg, S.C.

[73] Assignee: Milliken Research Corporation, Spartanburg, S.C.

[21] Appl. No.: 745,658

[22] Filed: Nov. 29, 1976

[51] Int. Cl.[2] ..... D06B 1/02; D06B 11/00

[52] U.S. Cl. ..... 8/150; 68/205 R; 427/286; 427/424

[58] Field of Search ..... 8/149, 150, 151; 68/205 R; 427/286, 424; 118/6, 313, 314, 315

[56] References Cited

U.S. PATENT DOCUMENTS

| | | | |
|---|---|---|---|
| 2,182,752 | 12/1939 | Janes | 68/205 R |
| 2,218,811 | 10/1940 | Chaussabel | 68/205 R X |
| 3,491,561 | 1/1970 | Crump | 68/205 R X |
| 3,937,045 | 2/1976 | Klein et al. | 68/205 R |

*Primary Examiner*—Philip R. Coe

*Attorney, Agent, or Firm*—Earle R. Marden; H. William Petry

[57] ABSTRACT

Apparatus and method to jet dye a sample fabric to determine dye characteristics and/or design esthetics of selected colors. The dye application apparatus applies a narrow band of the desired design on the fabric which is mounted on a table which can be indexed laterally of the dye applicator to lay down another narrow band of dye adjacent the initial dye application.

1 Claim, 7 Drawing Figures

FIG.-2-
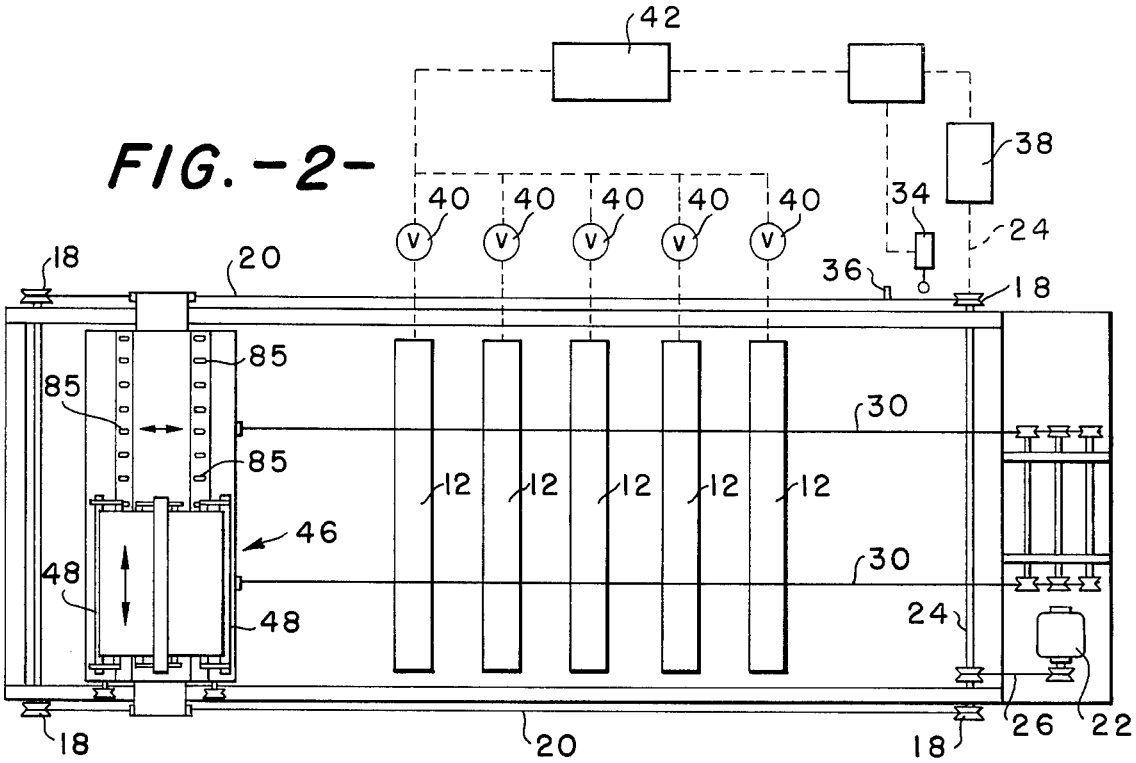
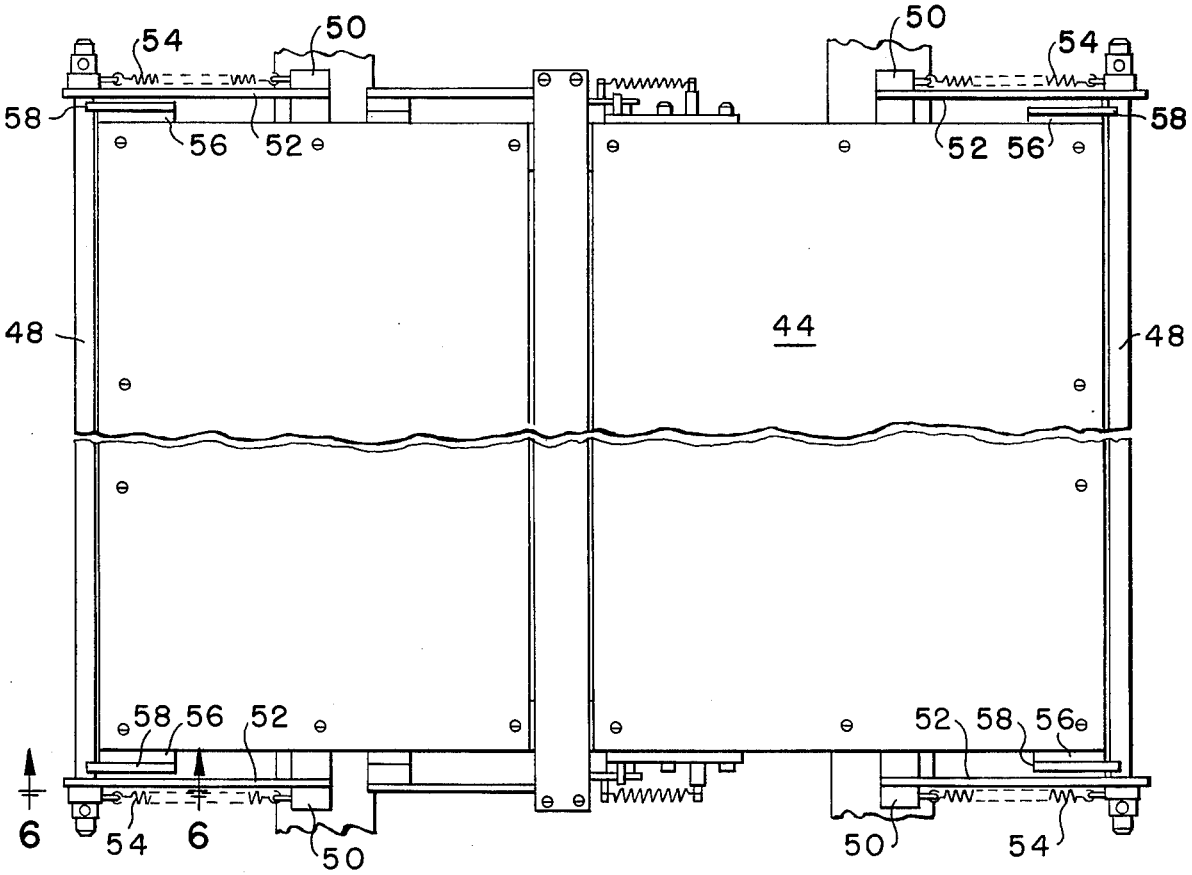
FIG.-4-

DYEING METHOD

It is an object of the invention to provide a method to dye sample fabrics without running the sample to be dyed through the production machine.

Other objects and advantages of the invention will become clearly apparent as the specification proceeds to describe the invention with reference to the accompanying drawings, in which:

FIG. 2 is a top schematic view of the jet dyeing arrangement shown in FIG. 1;

FIG. 4 is a top view of the carrier shown in FIG. 3;

Figure 1:
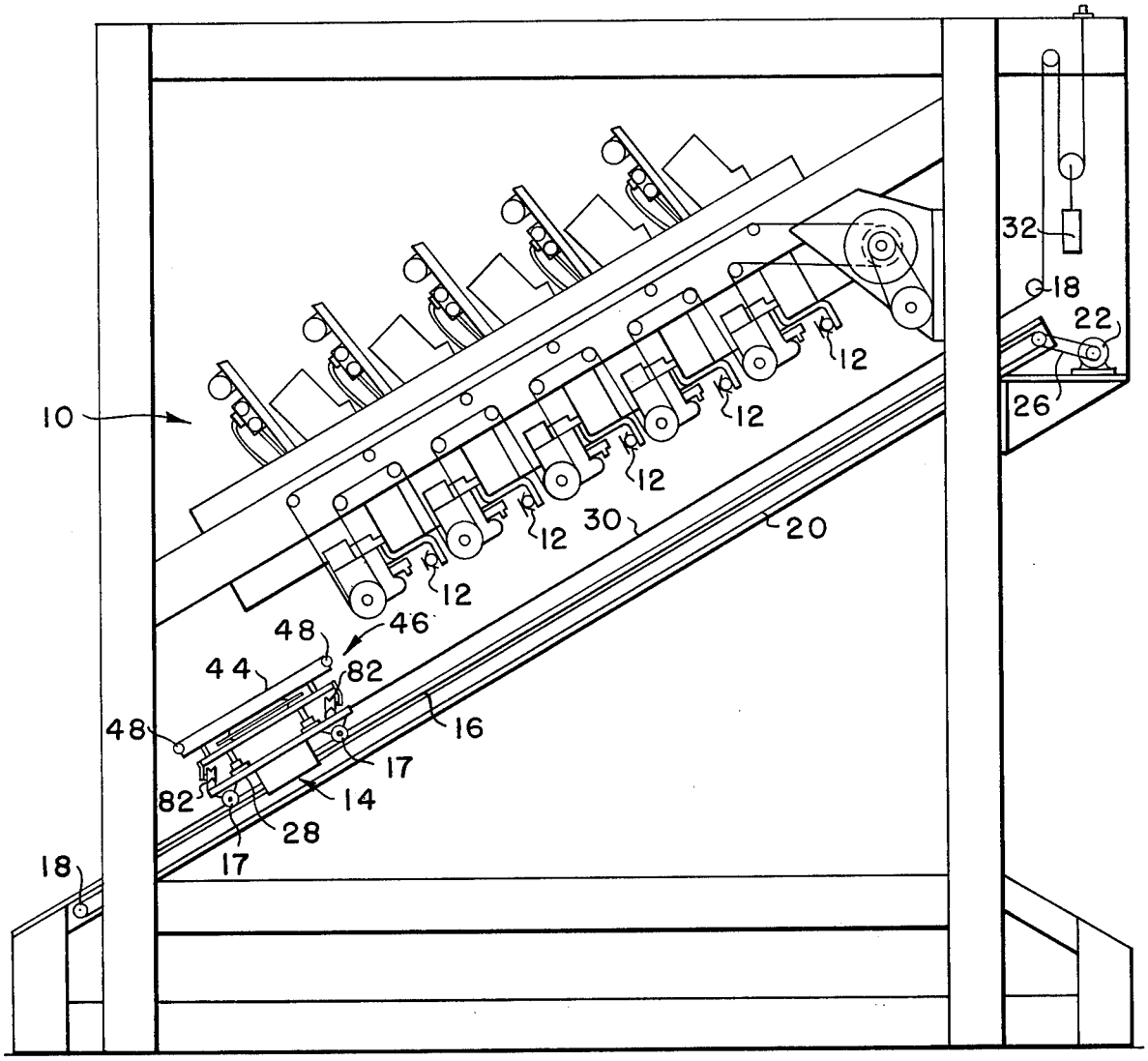
FIG. 1 is a schematic side elevation view of the new and improved jet dyeing arrangement.

FIGS. 1 and 2 illustrate the dyeing arrangement which is employed in the jet dyeing apparatus of U.S. Pat. No. 3,937,045 to color print textile fabrics such as pile carpets, tiles and the like. The jet dyeing gun bar arrangement 10 is generally similar to that shown in U.S. Pat. No. 3,937,045, supra, except that lengths of each of the gun bars 12 is substantially reduced since the apparatus illustrated is intended for use as a sample machine to test dyes, patterns and the like and not intended to be a production machine. For the sake of illustration, five gun bars 12 are shown to handle five different colors of dye but the number of such bars is arbitrary.

In operation a fabric carrier 14 is moved up and down the track 16 on wheels 17 by means of sprockets 18 and chains 20 driven by motor 22 through shaft 24 by means of chain 26. The chains 20 are connected to the base frame 28 of the carrier 14 which is counterbalanced by cables 30 and weights 32. The cables 30 and weights 32 also act to prevent the carrier 14 from sliding backwards suddenly if one of the chains 20 or 26 should break.

Each gun bar includes a dye supply manifold connected to the jet orifices of the bar which is supplied with liquid dyestuff from a reservoir so that each bar may be provided with a different color dye for printing the fabric. Typically, each gun bar may be provided with a primary color and operation of the individual jets of the gun bar are programmed to produce a desired pattern, with blending of the primary colors in situ on the surface of the fabric to provide many different shades and colors or one or more of the primary colors can be applied separately.

To ensure that the streams of dyestuff strike the carpet tile at an exact location to form the pattern in the carpet tile, control means are provided for coordination of the firing of each particular dye jet of the gun bars at the right time to the movement of the conveyor transporting the tiles for printing. As broadly shown in FIG. 2, the control system is provided with a synchronization switch 34 which is activated by a mechanical trip finger 36 attached to the edge of the chain 20 to engage the switch 34 at a given position of conveyor movement.

Operatively connected to the shaft 24 of sprocket 18 by suitable means, not shown, is a transducer 38 which converts the mechanical movement of chain 20 to a plurality of electrical pulses which activate firing of particular jets on the gun bars at desired positions of the conveyor, by controlling the pneumatic valves 40 through a suitable control 42.

When it is desired to dye a fabric sample, it is mounted on the top 44 of the carrier carriage 46 in a manner hereinafter explained. The motor 22 is then actuated and the carrier 14 is moved towards the motor 22 by the chains 20. As explained above, the gun bars are actuated as the carrier 14 moves downward to apply the desired pattern on a narrow width of the fabric sample. Then the motor is reversed to raise the carrier 14 for the next operation. When the carrier 14 is at the position, the operator can either remove the sample or index the carrier carriage 46 transverse of the carrier 14 and run the carrier 14 upward again to apply another narrow strip of dye on the fabric sample adjacent the first strip of dye on the same sample when it is once again lowered. In this manner, colors and/or patterns can be compared to one another without excessive manipulation of the machine and/or the sample fabric.

Figure 6:
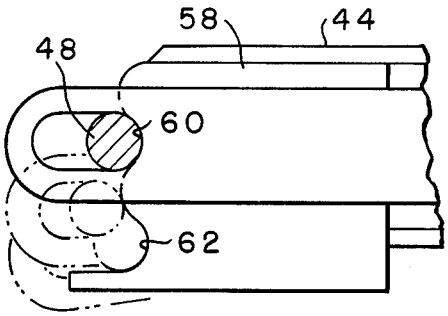
FIG. 6 is an elevation view taken on line 6—6 of FIG. 4.
Figure 7:
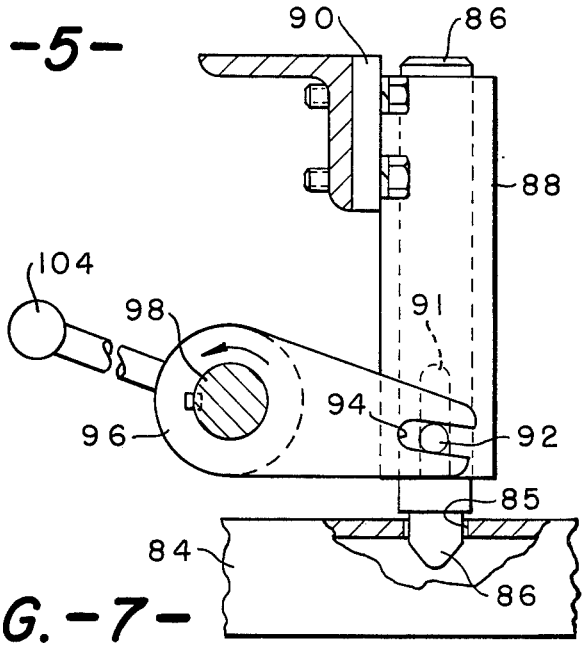
FIG. 7 is a cross-sectional view taken on line 7—7 of FIG. 5.

To secure the fabric sample on the carrier carriage 46, a pair of rod members 48 are pivotally mounted on each end of the top 44, each to a shaft 50 by lever arms 52. To bias the rod members 48 inward towards the shafts 50, a spring member 54 is connected to each shaft 50 and to both extremities of the rod member 48. Mounted on the opposite ends of the top 44 is a plate 56 with a plate 58 having an upper notch 60 and a lower notch 62 therein to accommodate the rod member 48. To load the carrier carriage, the rod members 48 are moved forward against the bias of the springs 54 and pivoted upwardly. The fabric sample is then placed on the top 44 and the rod members 48 pivoted downwardly. As the rod members 48 are replaced in the notches 60, the ends of the fabric sample are bent over the edges of the top and secured in place by the rod members 48 as the springs exert a bias on the rod members to hold them in the notches 60. The lower notches 62 are provided to allow the rod members 48 to be moved downwardly therein to release the edges of the fabric sample to those times when it is undesirable to pivot the rod members 48 outwardly and upwardly (See FIG. 6).

Figure 3:
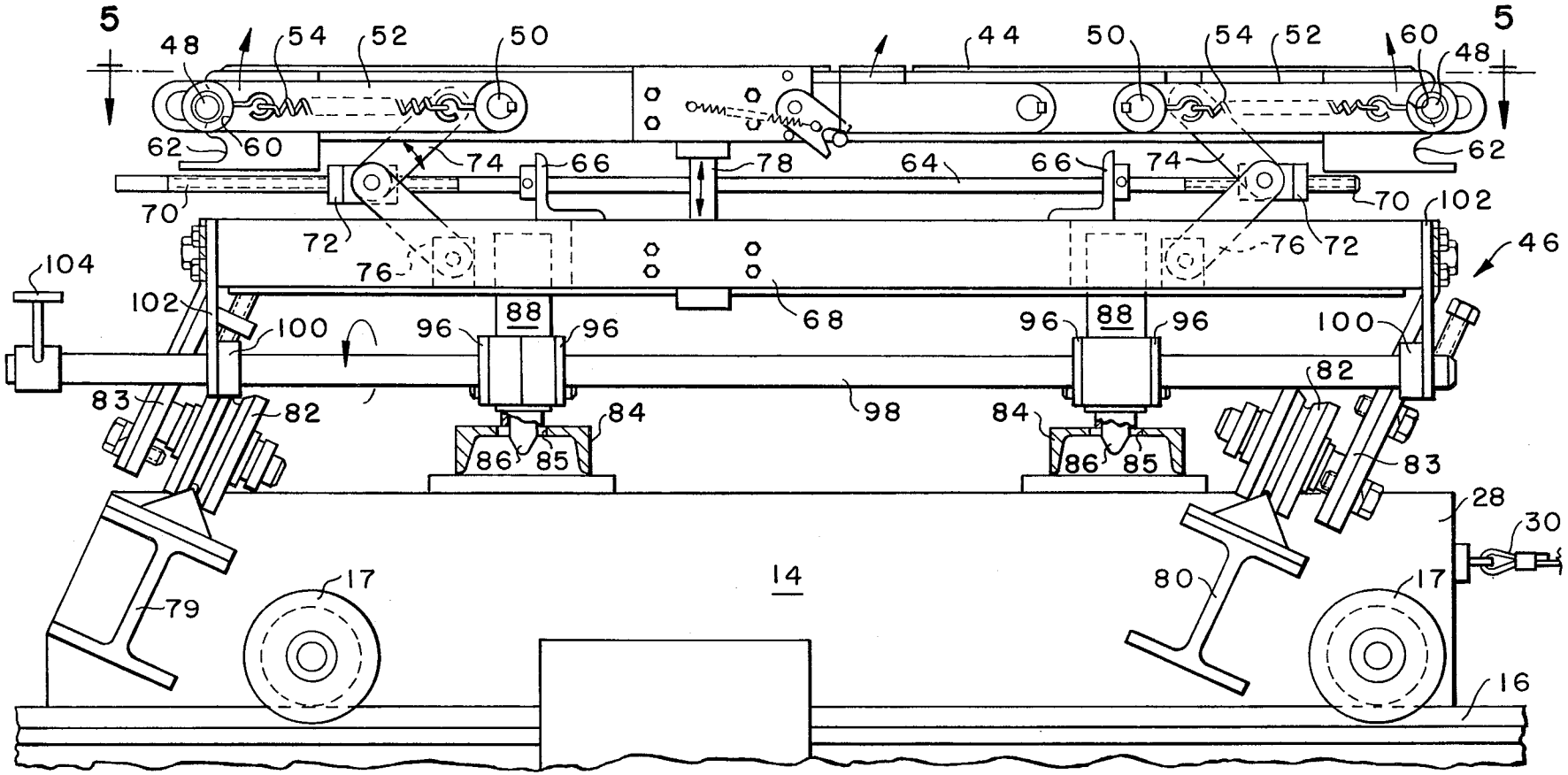
FIG. 3 is a side elevation view of the fabric carrier.
Figure 5:
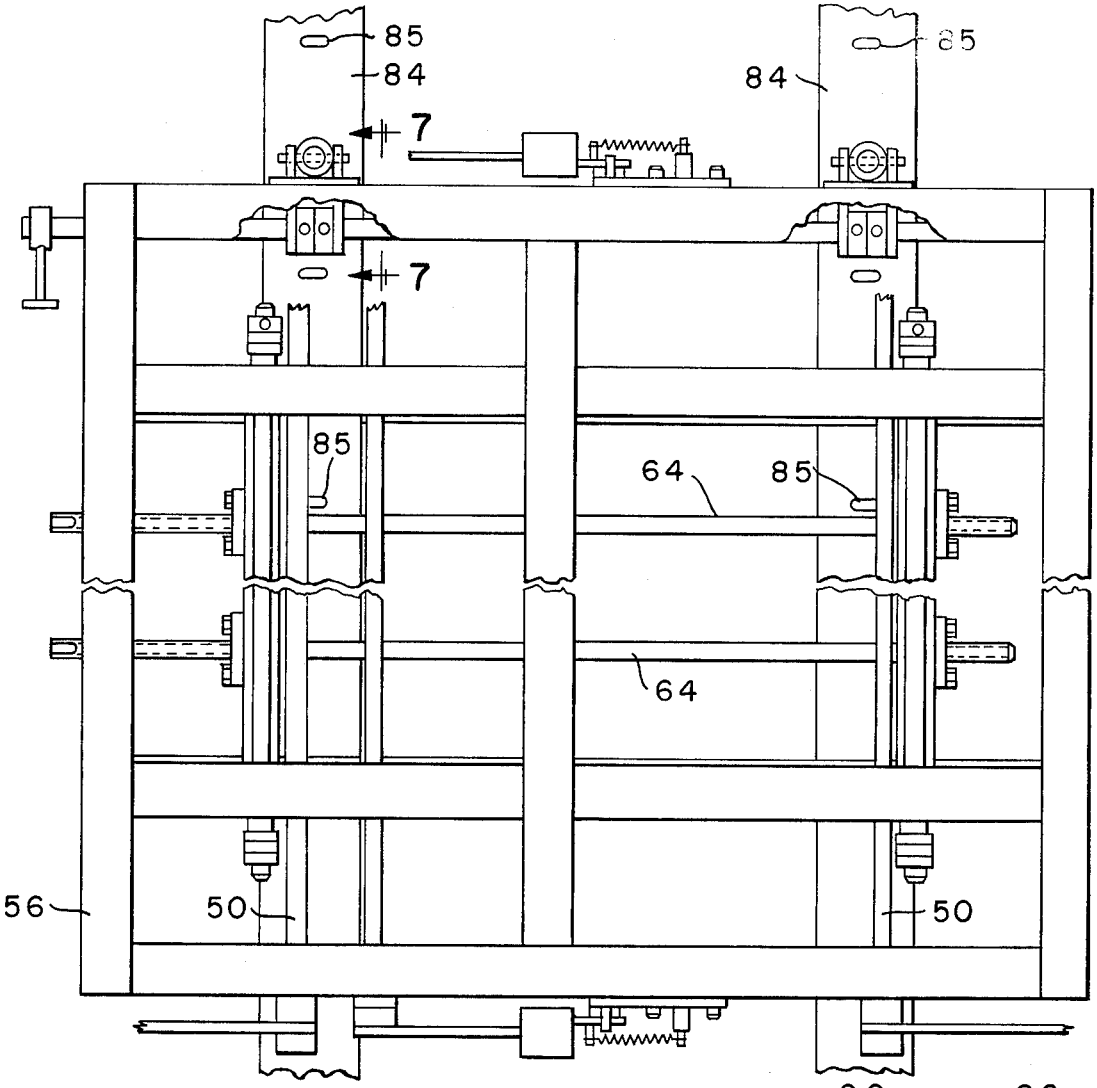
FIG. 5 is a view taken on line 5—5 of FIG. 3.

To adjust the level of the top 44 with respect to the gun bars 12, elevating rods 64 are rotably held in bearing brackets 66 mounted on the base 68 of the carrier carriage and have a screw right and left-hand thread 70 on each end thereof over which is telescoped an internally thread collar 72. Connected to each collar 72 is a pair of guide arms 74 and 76, one of which is attached to the base 68 and the other to the top 44. To aid in guiding the top 44 is a shaft 78 slidably mounted on the base 68. To raise or lower the top 44, a suitable tool is used to engage the left-hand ends (FIG. 3) of the rods 64 to rotate same to move the collars inward or outward to pivot the guide arms 74 and 76 to raise or lower the top 44.

As discussed briefly before, it is desired that the fabric sample be capable of movement transverse of the carrier so that a stripe of dye can be laid alongside a strip of previously dyed area. To this end, I-Beam tracks 79 and 80 are mounted to the carrier 14 and are engaged by a plurality of grooved wheels 82 rotably supported on support members 83 suitably connected to the base member 68 of the carrier carriage. To position the carrier carriage in the proper position, channel beam members 84 are mounted face down to the top of the carrier 14 and have a plurality of equally spaced openings 85 thereon to cooperate with detents 86 slidably mounted in collar 88. Collars 88 are fixed to support member 90 which is bolted on one edge of the base member. To move the detent 86 into and out of the openings 85, the collars 88 are provided with grooves 91 through which followers 92 project and are held in the grooves 94 of actuator arms 96. Arms 96 are fixed to the shaft 98 which are rotably held in suitable bearings 100 mounted in the plates 102 of the base member. A suitable handle 104 is connected to one end of shaft 98 to rotate the shaft 98, when desired. When it is desired to index or move the carrier carriage, the handle 104 is rotated counterclockwise to pull the detents out of their respective openings 85. The carrier carriage is then slid along track 79 and 80 to the desired position and handle 104 rotated clockwise to insert the detents 86 into the proper openings 85 and the carrier 14 is then ready for another run under the gun bars 12.

It can be seen that an apparatus and method has been described which will allow the dyeing of a narrow area of a sample fabric and another narrow area of the same sample fabric can also be dyed without removal of the fabric from the machine resulting in very little manipulation by an operator.

Although I described specifically the preferred embodiment of my invention, I contemplate that changes may be made without departing from the scope or spirit of the invention and I desire to be limited only by the scope of the claims.

I claim:

1. A method to dye a textile product comprising the steps: passing the textile product under a dye jet gun bar having a plurality of dye emitting orifices and a horizontal axis, applying a narrow pattern of dye on the textile product from the dye emitting orifices, indexing the textile product in a direction parallel to the horizontal axis of the gun bar, passing the textile product again under the dye emitting orifices to apply a second narrow pattern of dye on the textile product adjacent the first applied pattern of dye and removing the textile product from under the dye jet gun bar.

* * * * *